US008375532B2

(12) United States Patent
Yakubovich et al.

(10) Patent No.: US 8,375,532 B2
(45) Date of Patent: Feb. 19, 2013

(54) JEWELRY LOCKING MECHANISM

(75) Inventors: Nicky Yakubovich, Great Neck, NY (US); Surasith Sriorathaikul, Bangkok (TH)

(73) Assignee: Brilliant Jewelers/MJJ Inc., New York, NY (US)

( * ) Notice: Subject to any disclaimer, the term of this patent is extended or adjusted under 35 U.S.C. 154(b) by 325 days.

(21) Appl. No.: 12/791,796

(22) Filed: Jun. 1, 2010

(65) Prior Publication Data

US 2011/0289740 A1 Dec. 1, 2011

(51) Int. Cl.
*A44C 11/02* (2006.01)

(52) U.S. Cl. ..... 24/650

(58) Field of Classification Search ..... 24/643, 24/647, 648, 650
See application file for complete search history.

(56) References Cited

U.S. PATENT DOCUMENTS

| | | | | | |
|---|---|---|---|---|---|
| 468,677 | A | | 2/1892 | Maxheimer et al. | |
| 1,209,369 | A | * | 12/1916 | Wood | 24/648 |
| 1,368,665 | A | | 2/1921 | Strauss | |
| 1,459,674 | A | * | 6/1923 | Jabner | 24/634 |
| 1,464,452 | A | | 8/1923 | Starck | |
| 2,694,244 | A | * | 11/1954 | Nolan | 24/650 |
| 3,345,713 | A | | 10/1967 | Gaupp | |
| 3,638,287 | A | | 2/1972 | Wright et al. | |
| 3,693,221 | A | * | 9/1972 | Cunningham | 24/650 |
| 3,947,932 | A | | 4/1976 | Flynn | |
| 4,001,923 | A | | 1/1977 | Frankel et al. | |
| 4,170,809 | A | | 10/1979 | Geldwerth et al. | |
| 4,246,680 | A | | 1/1981 | Gray | |
| 4,286,360 | A | | 9/1981 | Skobel | |
| 4,321,734 | A | | 3/1982 | Gandelman | |
| 4,426,854 | A | | 1/1984 | Geldwerth et al. | |
| 4,443,916 | A | | 4/1984 | Tiemann | |
| 4,458,392 | A | | 7/1984 | Pogharian et al. | |
| 4,458,393 | A | | 7/1984 | Pogharian et al. | |
| 4,532,682 | A | | 8/1985 | Murao | |
| 4,534,090 | A | | 8/1985 | Skobel | |
| 4,543,695 | A | | 10/1985 | Dorsey | |
| 4,562,704 | A | | 1/1986 | Benedek et al. | |
| 4,651,390 | A | | 3/1987 | Skobel | |
| 4,794,814 | A | | 1/1989 | Ferguson, Jr. | |
| 4,881,305 | A | | 11/1989 | Rivera | |
| 4,893,383 | A | | 1/1990 | Quickel | |
| 4,924,562 | A | | 5/1990 | Pogharian | |
| 5,075,936 | A | | 12/1991 | Glaser | |
| 5,095,594 | A | | 3/1992 | Marosy | |
| 5,272,795 | A | | 12/1993 | Rothstein | |
| 5,309,616 | A | | 5/1994 | Sobin | |
| 5,435,047 | A | | 7/1995 | Colpo | |

(Continued)

OTHER PUBLICATIONS

Written Opinion and International Search Report for PCT/US2011/038804 mailed on Oct. 4, 2011.

*Primary Examiner* — James Brittain
(74) *Attorney, Agent, or Firm* — Hershkovitz & Associates LLC; Abraham Hershkovitz

(57) ABSTRACT

A jewelry clasp is provided with a male element and a female element. The female element has a chamber with a frame and an internal stop element that is integral with the frame. The chamber includes a pivot for a pivotally-mounted spring-biased latch element so that the latch element is not placed in the trajectory of the entry path of the male element into the entry port of the chamber, and the latch element is configured to abut the chamber frame such that, in every position, the latch element remains within the chamber frame and does not extend beyond the frame when the male element is engaging, engaged, disengaging or disengaged.

2 Claims, 5 Drawing Sheets

U.S. PATENT DOCUMENTS

| | | | |
|---|---|---|---|
| 5,459,909 | A | 10/1995 | Nussberger |
| 5,628,095 | A | 5/1997 | Appel et al. |
| 5,832,573 | A | 11/1998 | Howell |
| 6,014,973 | A | 1/2000 | Kaufman |
| 6,035,499 | A | 3/2000 | Ninomiya |
| 6,202,268 | B1 | 3/2001 | Goldstein et al. |
| 6,260,381 | B1 | 7/2001 | Zettl |
| 6,301,757 | B1 | 10/2001 | Kunii et al. |
| 6,317,941 | B1 | 11/2001 | Hamm, Jr. |
| 6,370,914 | B1 | 4/2002 | Bruner |
| 6,381,814 | B1 | 5/2002 | Colpo |
| 6,389,660 | B1 | 5/2002 | Kataw |
| 6,481,069 | B1 | 11/2002 | Cheng |
| 6,484,376 | B1 | 11/2002 | Khatchadourian |
| 7,007,507 | B2 | 3/2006 | Enevoldsen |
| 7,320,160 | B2 | 1/2008 | Uehara et al. |
| 7,334,433 | B1 | 2/2008 | Fuhrman et al. |
| 7,481,075 | B2 | 1/2009 | Lindenman |
| 7,503,187 | B2 | 3/2009 | Richardson |
| 7,523,527 | B2 | 4/2009 | Garber |
| 2003/0066171 | A1 | 4/2003 | Terzian |
| 2007/0271739 | A1 | 11/2007 | Slautterback |

* cited by examiner

JEWELRY LOCKING MECHANISM

FIELD OF THE INVENTION

The present invention relates generally to jewelry, and more specifically, to clasps for securing two ends of a piece of jewelry together.

BACKGROUND

Conventional jewelry clasps for securing two ends of a piece of jewelry together have several deficiencies. For instance, conventional jewelry clasps are difficult to engage and disengage; they are prone to breaking over time; they snag on clothing and hair; they are unnecessarily complex in mechanical design; and they lack security as they often inadvertently open, inter alia.

Specifically, in conventional clasps, the friction and tension of component parts on other component parts and with external objects, including but not limited to hair and clothing, cause wear over time. Such wear is one reason that these clasps often break or inadvertently disengage, and the like. Accordingly, a wearer must carefully engage and secure the jewelry clasp, making sure that overuse and stress on the clasp does not cause the clasp to break or inadvertently disengage, and the like. The result of a broken or inadvertently disengaged clasp can result in a very expensive item falling off of a wearer's arm or neck, or being lost, for example.

It has long been a goal of jewelry clasps to be simple to operate, of a simple mechanical design, and durably made, to name just a few of the generally sought after qualities of jewelry clasp users. It is also desirable to have a locking mechanism for the clasp that has a completely internal engagement mechanism design, both when the two engaging elements are engaged and during the entire process of engaging and disengaging the two component parts. For example, many of the conventional mechanisms aver to be "internal only." However, they are only internal when the two parts are engaged, not during the process of engagement and disengagement. Having a completely internal clasping/locking mechanism is an important desire of jewelry clasp users because the latch or hook of a clasp is often protruding from the chamber or housing of the lock when the clasp is opened. The moment when the clasp is open also happens to be a time in which a user is likely to catch the apparatus on clothing and hair. Accordingly, having a hook tip that is internal will prevent a major source of snagging and breaking.

It is further desirable to have a completely internal, simple and durable stop mechanism. Conventionally, this goal has been achieved by having the existing components of the lock or clasp serve as the stop. This is thought to eliminate the need to add additional components to the clasp. For example, a pivot pin element is often used as the stop mechanism merely because it lies in the trajectory of the entering male element and is therefore going to stop the entering male element when they contact one another. However, this design has the disadvantage of putting pressure on the pivot pin element, for example, every time the engaging action is taken. Additionally, to remove the male element, a release tab or the like is usually depressed, which causes the pivot pin to force the male element out of the housing. This conventional disengagement action requires more force to be applied to the release tab as well as adding additional friction of the component parts between one another. Although this may not be a significant amount of force on the pin or other components, a person who wears jewelry with a clasp three times per week will engage and disengage the jewelry a minimum of 780 times over a five year period, and 1,560 times over a ten year period. A small amount of pressure so many times can result in breakage.

Thus, a device that it simple, entirely internal to a housing, and one that limits the stress of years of snagging, engaging, disengaging, etc., is highly desirable and not disclosed by any previous art. Some of the previous art is described below, all of which are incorporated herein by reference in their entirety as if they were repeated in full herein.

One type of conventional mechanical stop is described in U.S. Pat. No. 4,794,814 (hereinafter "the '814 patent"), and is incorporated herein by reference in its entirety. The '814 patent explains that most mechanical devices are increasingly reliable as the construction of the device becomes simpler. Thus, with this general idea in mind, a clasp with one hundred component parts, with everything else being equal, will be less reliable than a device performing the same function with only five component parts. Therefore, a simple mechanical stop, for example, is desirable.

An example of an entire clasp is provided for in U.S. Pat. No. 6,481,069 (hereinafter "the '069 patent"), and is incorporated herein by reference in its entirety. The '069 patent shows a clasp having an external mechanical stop comprising a sleeve that protrudes outside of the general frame of the housing. In addition, the '069 patent places the pivot directly in the trajectory of the male engaging part, which requires larger pivot range to engage and disengage the two component parts. Finally, the apparatus of the '069 patent is not entirely internal, as FIG. 6, in particular, shows that the entire latch raises outside and beyond the periphery of the general structure when it is in the process of preparing to receive the male component.

Another example of a entire clasp is provided for in U.S. Pat. No. 4,924,562 (hereinafter "the '562 patent"), and is incorporated herein by reference in its entirety. The '562 patent shows a clasp with an externally-protruding stop, a pin directly in the trajectory of the male engaging element, and a male engaging element that directly contacts the hook. Therefore, friction exists between the hook and the pin, such that disengaging the clasp requires more force and wear and tear over time is likely to increase. Additionally, when the groove in the apparatus of the '562 patent is depressed, the hook extends well beyond the periphery/frame of the device, which increases the likelihood that such extensions will get caught on external objects.

Yet another example of an entire clasp is described in U.S. Pat. Pub. No. 2003/0066171 (hereinafter "Terzian"), and is incorporated herein by reference in its entirety. Terzian shows a hook that, when opened, extends well outside of the frame of the clasped device. In addition, the insertion element in Terzian directly abuts the stop portion, which is integral with the catch element. Further, the trajectory of the insertion element is directed towards the pin of the pivot. Even further, the male element has a circular notch which acts as an external catch.

SUMMARY

According to the present invention, a jewelry clasp is provided that is simple, places minimal stress on the component parts and is compact in operation, with an entirely internal stop mechanism and a mechanical structure that requires minimal pivoting and movement of the internal component parts, thereby increasing the longevity of the clasp.

In one aspect of the present invention, a clasp is configured to connect to at least one jewelry item, which can be a necklace, a bracelet, and the like. The clasp has a female element with a chamber frame that encloses a chamber. The clasp also has a pivotally-mounted spring-biased latch element and a port within the chamber frame. The port has an internal stop element that defines the depth of the port. Additionally, a portion of the port has an opening that faces the pivotally-mounted spring-biased latch element. Further, the pivotally-mounted spring-biased latch element has a hook, a release tab, a spring and a pivot pin, each of which are spaced from the internal stop element. The hook has a hook tip. The clasp also has a male element that is shaped, sized and configured to enter the port. Further, the male element has a sloping outer edge and a notch that is spaced from the sloping side or edge. When the male element is inserted into the female element, the hook tip at the end of the hook is configured to (a) engage with the sloping outer side or edge of the male element, through the port opening and (b) engage the notch. The notch can be configured to prevent the male element, once inserted into the female element, from being removed from the female element. Additionally, the internal stop element can be configured to prevent the male element from moving deeper into the female element.

In one embodiment of the present invention, the hook is configured to slide along the sloping outer side of the male element as the male element is being inserted into the female element, until the hook tip engages the notch of the male element. As the hook tip engages the notch through the port opening, the male element will abut the internal stop element. The chamber frame can be any appropriate shape, e.g., round, oval, square, cushion-shaped, heart-shaped, rectangular, octagonal, hexagonal, pear-shaped, triangular, or any combination thereof.

According to another embodiment of the present invention, the hook can be shaped, sized and configured to sealably align with the chamber frame when the pivotally-mounted spring-biased latch element is in every position, including engaging, disengaging, engaged and disengaged. When the pivotally-mounted spring-biased latch element sealably aligns with the chamber frame, it prevents the hook tip, for example, from disrupting the smooth outer surface of the clasp. Such configuration ensures that the clasp can be shaped, sized and configured for any appropriate use, and the outer surface with be less likely to catch on hair, clothing and other external objects.

In yet another embodiment, the hook can be configured to abut the chamber frame when the release tab is depressed and when the release tab is in a resting position. This prevents the hook tip from protruding beyond the plane of the chamber frame because the frame physically gets in the way of the hook. This is yet another way that the catching of hair, clothing and external objects is prevented. Additionally, the internal stop element can be integral with the chamber frame.

In another embodiment of the present invention, the external side of the chamber can be shaped, sized and configured to display a logo, an insignia, a mark, an engraving, or any combination thereof.

In still another embodiment of the present invention, the clasp can be made of any material, including but not limited to, a metal, a polymer, a ceramic, or any combination thereof. The metal can be any appropriate metal, e.g., stainless steel.

In another aspect of the present invention, a clasp is provided that is configured to connect to at least one jewelry item, which can be a necklace, bracelet, and the like. A female element has a chamber frame that encloses a chamber and a pivotally mounted spring-biased latch element. The pivotally-mounted spring-biased latch element has a hook, a release tab, a spring and a pivot pin that are spaced from an internal stop element. The hook has a hook tip and the spring is held in place by at least one post that can be shaped, sized and configured to limit the movement of the spring. The chamber frame has a port, and the external side of the chamber frame can be shaped, sized and configured to display at least one of a logo, insignia, mark, engraving, or any combination thereof. Additionally, the port has an opening and an internal stop element that defines the depth of the port. Further, a male element can be shaped, sized and configured to be received in the port, and the male element has a sloping outer side with a notch spaced therefrom. The pivot pin can be positioned beyond the trajectory of the male element's entry into the port. The male element can be attached to one of, a necklace, a bracelet, or any combination thereof, and the port can be configured to allow the hook tip to engage the notch when the release tab is in a resting position and the male element is in contact with the internal stop element. As the male element enters the female element, the hook tip will (a) engage with the sloping outer side of the male element through the port opening, and (b) engage the notch. The notch can be configured to prevent the male element from being removed from the female element and similarly, the internal stop element can be configured to prevent the male element from moving deeper into the female element.

The pivotally-mounted spring-biased latch element can be configured to sealably align with the chamber frame when the pivotally-mounted spring-biased latch element is at least one of, engaging, disengaging, engaged, disengaged, or any combination thereof, with/from a male element.

In another embodiment of the present invention, the port opening cam be shaped, sized and configured for receiving a hook tip.

In still another embodiment, the at least one post, the port and the internal stop element can each be or are all integral with the chamber frame.

In yet another embodiment, the part of the male element that enters the port can be symmetrical, such that the hook tip can engage the notch at any angle of insertion.

In yet another embodiment, each of or both the male element and the female element can display at least one of a logo, insignia, design, mark, engraving, or any combination thereof.

In still another embodiment of the present invention, the release tab and the external side sealably align when each of the male element and female element is in any position, including being engaged, disengaged, engaging and disengaging.

According to another embodiment of the present invention, the pivot pin can be spaced from the internal stop element, and the port opening can be shaped, sized and configured for receiving a hook tip or other engaging element. The pivot pin can be positioned directly above the internal stop element, and the at least one post, the port and the internal stop element can each be or are all integral with the chamber frame. Further, the part of the male element that enters the port can be symmetrical, such that the notch will engage the hook tip at any angle of insertion. The male element and the female element can each or both bear at least one of a logo, insignia, design, mark, engraving or any combination thereof.

The present invention provides a method for clasping at least one jewelry item in which a jewelry item has two ends and a clasp, each of the two ends being connected to the clasp. The clasp has a female element having a chamber frame enclosing a chamber and a pivotally-mounted spring-biased latch element. The chamber frame has a port and the port has an internal stop element that defines the depth of the port. Additionally, the pivotally-mounted spring-biased latch element has a hook, a release tab, a spring and a pivot that are spaced from the internal stop element. The hook has a hook tip. A male element can be shaped, sized and configured to be received in the port, and the male element has a sloping outer side or edge and a notch spaced therefrom. The hook tip can be configured to (a) engage with the sloping outer edge, and (b) engage the notch. The notch can be configured to prevent the male element from being removed from the female element, and the internal stop element can be configured to prevent the male element from moving deeper into the female element. The male element is connected to the other of the two ends of the at least one jewelry item. The male element can be inserted into the port of the female element so that the hook tip of the hook slides upward along the sloping outer side of the male element until the hook tip engages the notch of the male element and the male element comes in contact with the internal stop element, whereby the two ends of the at least one jewelry item are secured to each other.

BRIEF DESCRIPTION OF THE DRAWINGS

The present invention is further described in the detailed description which follows, with reference to the drawings by way of non-limiting examples of embodiments of the present invention, in which like reference numerals represent similar parts throughout the several views of the drawings, and wherein.

DETAILED DESCRIPTION OF THE INVENTION

Figure 1:
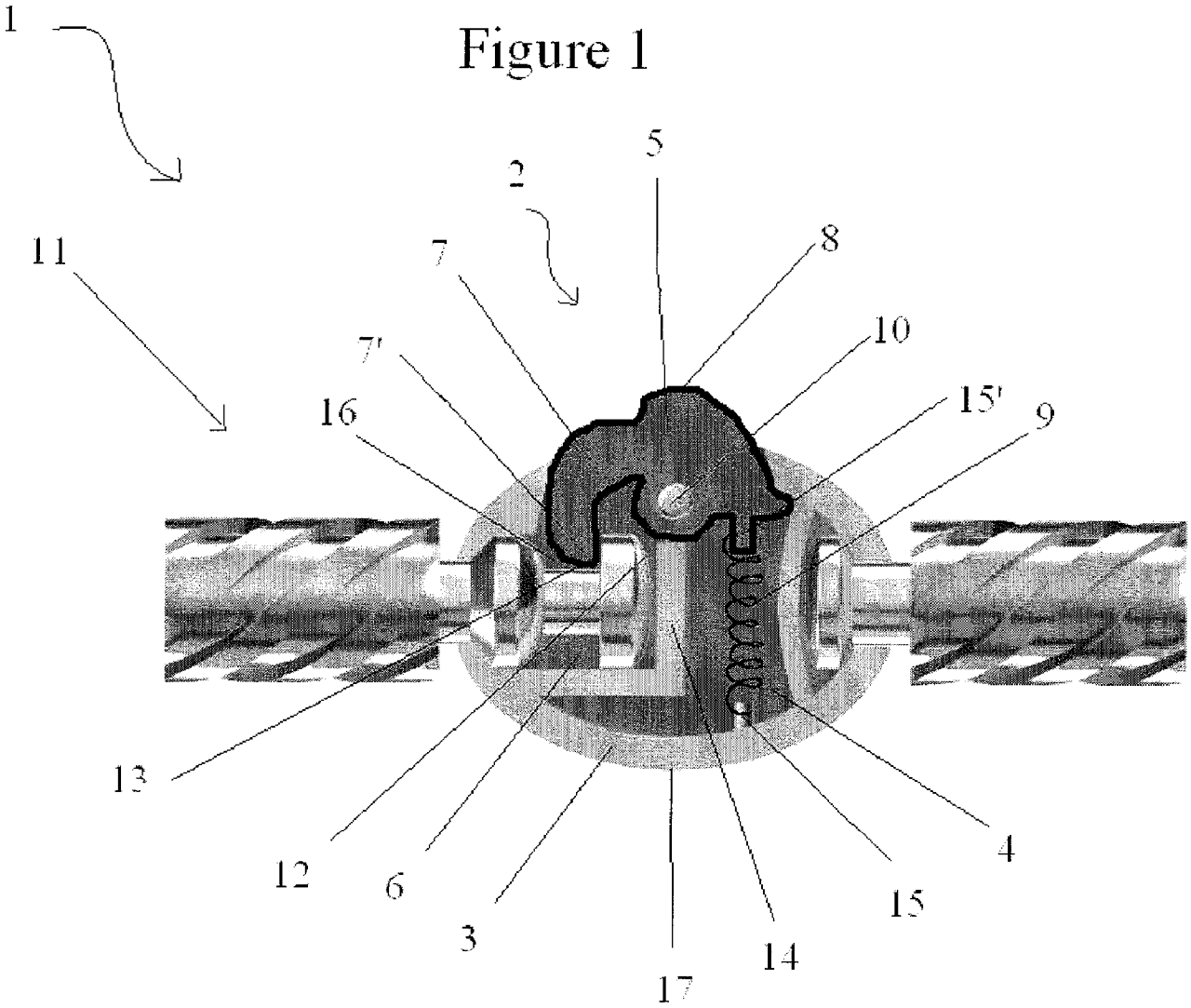
FIG. 1 is a perspective sectional view according to one or more embodiments of the present invention with a male element in the engaged position with a female element.
Figure 2:
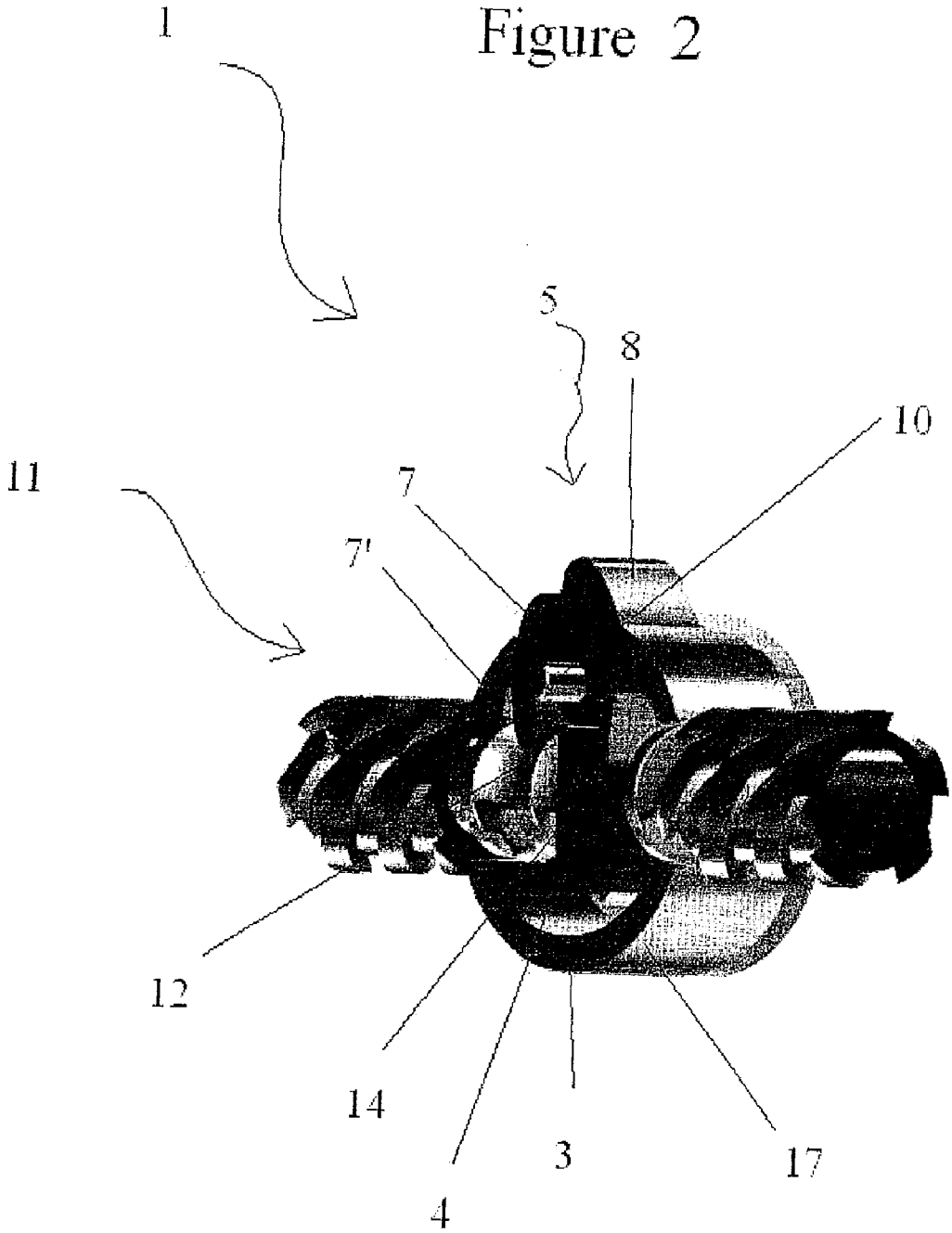
FIG. 2 is a perspective elevational view according to one or more embodiments of the present invention in the engaged position with a female element.

FIGS. 1 and 2 show perspective sectional/elevational views according to one or more embodiments of the present invention, with a male element in the engaged position with a female element. The male element and the female element can be attached to any piece of jewelry, including a necklace, a bracelet, or any combination thereof.

Figure 5:
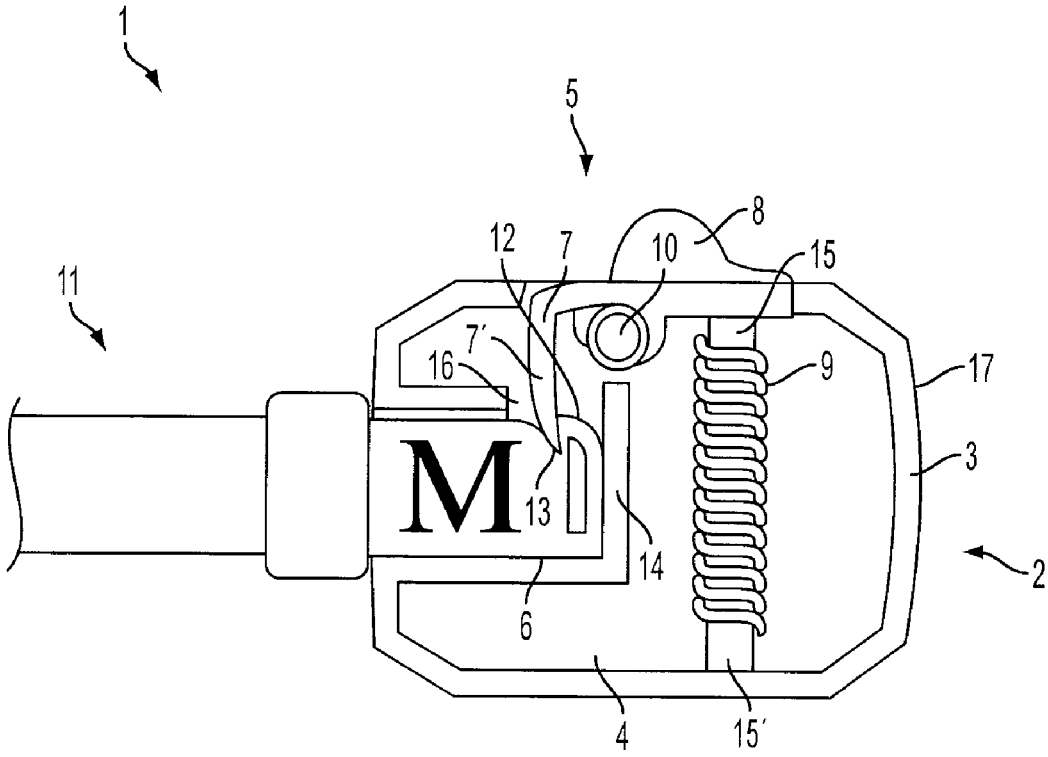
FIG. 5 is a sectional view according to one or more embodiments of the present invention, with a male element in the engaged position with a female element.

FIGS. 1 and 2 show a clasp (1) having a female element (2) and a male element (11). The female element (2) can have a chamber frame (3) that encloses a chamber (4). The chamber (4) can have a port (6) with an internal stop element (14). The internal stop element (14) can serve as a back wall of the port (6) of chamber (4), and it can be fixed in place. When the male element (11) is inserted into the female element (2), as shown in FIGS. 1, 2 and 5, the internal stop element (14) can prevent the male element (11) from moving deeper into the female element (2). In addition, the internal stop element (14) can be integral with the chamber frame (3), as it can be formed as an extension of the chamber frame (3) rather than as a separate and distinct component. The port (6) also has an port opening (16) to the chamber (4), which is configured to allow an engaging element, including but not limited to a hook (7), which can include a hook tip (7') at a free first end, to enter the port (6) to engage a notch (13) on the male element (11). The port (6) can be integral with the chamber frame (3), rather than as a separate and distinct component. The notch (13) can be in various shapes and sizes, including but not limited to, a "V" shape, a "U shape", a rectangular shape, or any combination thereof. The female element (2) can have a spring-biased pivotally-mounted latch element (5) with a release tab (8), such that when the release tab (8) is depressed in a downward direction at an appropriate angle, the spring-biased pivotally-mounted latch element (5) can be rotated about a pivot pin (10). The release tab (8) can be of any shape, so long as it remains smooth and not prone to catching on hair, clothing or other external objects. The spring-biased pivotally-mounted latch element (5) can be shaped, sized and configured such that the hook tip (7') at the first end of the hook (7) can remain within the chamber (4) in all positions, including during all phases of rotation of the hook about the pivot pin (10). As can be seen in FIGS. 1, 2 and 5, such a configuration can prevent any part of the hook tip (7') from protruding beyond the smooth external side (17) of the chamber frame (3). Additionally, the spring-biased pivotally-mounted latch element (5) can be configured to sealably align with the chamber frame (3) in every position of element (5), such that there will not be protruding component parts or gaps that are prone to snag on hair, clothing or other external objects. The external side (17) of the chamber frame can include logos, marks, displays, engravings, or any combination thereof.

As described above, the spring-biased pivotally-mounted latch element (5) can have a hook tip (7') at a first end of the hook (7) which can enter the port opening (16) to engage the notch (13). The second end of the spring-biased pivotally-mounted latch element (5) can have a spring (9) which can be held in place by at least one post (15). FIGS. 1 and 5 show two posts (15, 15') holding the spring (9) in place. The posts (15, 15') can be integral to the chamber frame (3) in some embodiments. However, other configurations are possible, such as having one post instead of two, and each post being a separate and distinct element from the chamber frame (3).

The male element (11) can have an outer side (12) from which the notch (13) can be oppositely spaced. The outer side (12) can be sloping, angled or otherwise suitably configured to allow hook tip (7') to move along its surface. As the male element (11) is inserted into the port (6) of the female element (2), the hook tip (7') of the spring-biased pivotally-mounted latch element (5) can slide across the sloping outer side (12) of the male element (11) while the spring (9) compresses. When the hook tip (7') slides far enough up and along the sloping outer side (12), it can securely engage (i.e., hook onto) the notch (13) of the male element (11). The notch can be of any shape and configuration suitable for receiving an engaging element, including but not limited to, a rectangular shape, as shown in FIG. 1, a "V" shape, a "U" shape, a square-shape, or any combination thereof. As shown in FIG. 1, the male element (11) can only contact the port (6) and the hook tip (7') when confined within the port (6), thereby not placing any stress or friction directly on any other component of the clasp (1). In one or more embodiments, the trajectory of the male element's entry into the port (6) can be spaced from the pivot pin (10).

When the hook (7') of female element (2) engages the notch (13) of male element (11), male element (11) can be prevented from further entry into the female element (2) by contact with the internal stop element (14). In addition, the male element (11) can be prevented from being removed from the female element when the hook tip (7') engages notch (13), thereby preventing the male element (11) from backing out of port (6) while it is engaged.

To release and disengage the male element (11) from the female element (2), the release tab (8) can be depressed, such that the spring (9) compresses and the hook tip (7') rises out of the notch (13) and above port opening (16) far enough that the male element (11) can move backward out of port (6). Once the male element (11) is displaced from the port (6), the spring (9) will decompress because the hook tip (7') will fall back in a resting position, similar to the position that it is in while engaged with the male element (11), as shown in FIGS. 1, 2 and 5. Also as shown in FIGS. 1 and 5, during disengagement of the male element (11) from the female element (2), the port (6) and the hook tip (7') are the only components of the female element (2) that contact the male element (11).

Other embodiments can have other configurations of tension elements that can take the place of the spring compression/depression mechanism as described above, as long as the latch mechanism having a hook tip (7') engagement with the notch that is described above is maintained. For example, a different spring or bias element can be positioned elsewhere within the clasp in lieu of the spring and posts configuration shown in FIGS. 1 and 5, such as a tension spring that compresses/depresses in an opposite direction as compared to the spring in FIGS. 1 and 5 and yet still be able to hold the hook in a desired position. Instead of a spring, as shown in FIGS. 1 and 2, other compression elements can be used, such as but not limited to, foams, elastomers, or even a combination of springs and foams or elastomers.

Figure 3:
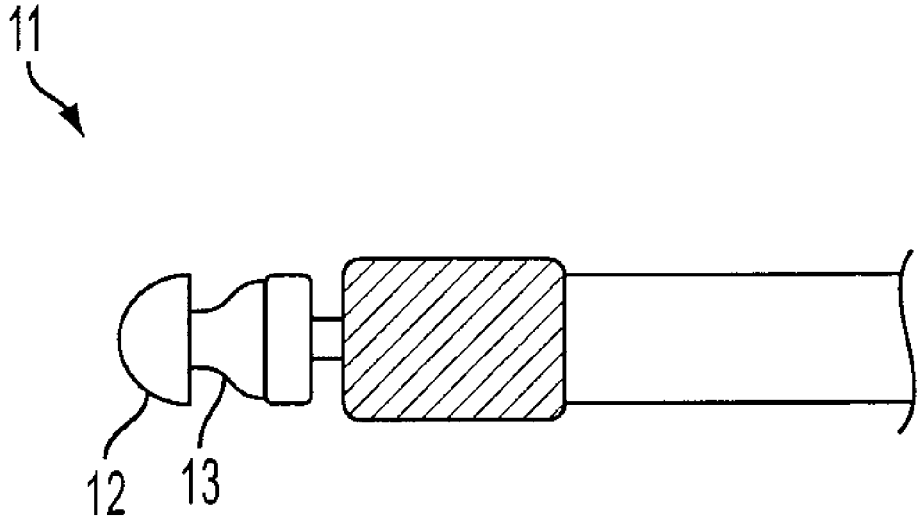
FIG. 3 is a view of a male element not engaged with a female element, according to one or more embodiments of the present invention.
Figure 4A:
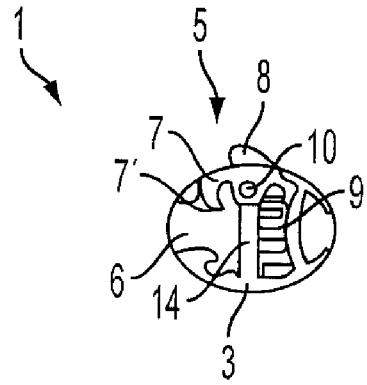
FIG. 4A is a sectional view of a female element not engaged with a male element.
Figure 4B:
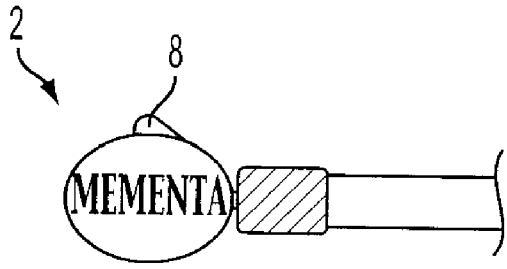
FIG. 4B is an external view of a female element according to one or more embodiments of the present invention.
Figure 4C:
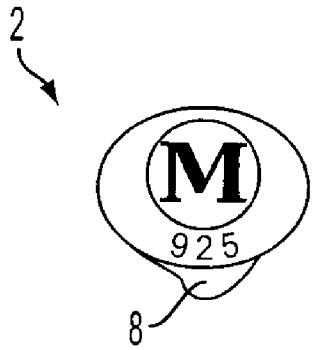
FIG. 4C is another external view of a female element according to one or more embodiments of the present invention.

FIGS. 3 and 4A depict the male element (11) and female element (2), respectively, in disengaged positions, as discussed above. FIGS. 4B and 4C also shows that the external side (17) of the female element (2) can carry a logo, engraving, mark, insignia, or the like.

FIG. 5 shows another embodiment wherein notch (13) is "V" shaped, with an insignia on the male element (11). Additionally, the chamber frame (3) can be in any shape, including but not limited to, round, oval, square, cushion-shaped, heart-shaped, rectangular, octagonal, hexagonal, pear-shaped, triangular, or any combination thereof.

The components of the jewelry clasp can be made of any suitable material, including but not limited to, any metal, polymer, ceramic material, or any combination thereof. Additionally, the spring can be any type of spring, including but not limited to, compression springs, helical springs, high and low tension springs, and the like.

Accordingly, a jewelry clasp is disclosed which has a simple mechanical structure, is reliable and durable. Thus, a heightened level of security for jewelry clasps has been reached with the present invention not shown or disclosed in any prior art.

It is noted that the foregoing examples have been provided merely for the purpose of explanation and are in no way to be construed as limiting of the present disclosure. While the present disclosure has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A clasp configured to connect to at least one jewelry item, the clasp comprising:

a female element comprising a chamber frame that encloses a chamber and a pivotally mounted spring-biased latch element;

the pivotally-mounted spring-biased latch element comprising the following elements that are spaced from an internal stop element:

a hook;

a release tab;

a spring; and a pivot pin;

the hook having a hook tip;

the spring being held in place by at least one post that is shaped, sized and configured to limit movement of the spring;

the chamber frame comprising a port;

the chamber comprising an external side that is shaped, sized and configured to display at least one of, a logo, insignia, mark, an engraving, or any combination thereof;

a port comprising an opening and an internal stop element that defines the depth of the port; and a male element shaped, sized and configured to be received in the port, the male element comprising a sloping outer edge and a notch spaced therefrom;

the pivot pin being positioned beyond the trajectory of the male element's entry into the port;

the male element being attached to one of, a necklace, a bracelet, or any combination thereof;

the port being configured to allow the hook tip to engage the notch when the release tab is in a resting position and the male element is in contact with the internal stop element;

the hook tip being configured to (a) engage with the sloping outer edge of the male element through the port opening and (b) engage the notch;

the notch being configured to prevent the male element from being removed from the female element; and the internal stop element being configured to prevent the male element from moving deeper into the female element; and the pivotally-mounted spring-biased latch element being configured to sealably align with the chamber frame when the pivotally-mounted spring-biased latch element is at least one of, engaging, disengaging, engaged, disengaged, or any combination thereof, with/from the male element; and wherein the pivot pin is spaced from the internal stop element;

the port opening shaped, sized and configured for receiving the hook tip;

the pivot pin is positioned directly above the internal stop element;

the at least one post, the port, and the internal stop element are each integral with the chamber frame;

the part of the male element that enters the port is symmetrical, such that the notch will engage the hook tip at an angle of insertion; and the male element and the female element bear at least one of, a logo, insignia, design, mark, engraving or any combination thereof.

2. The clasp according to claim 1, wherein the release tab and the external side sealably align while the male element and female element are engaged, disengaged, engaging and disengaging.

* * * * *